US006679411B2

(12) United States Patent
Popovich et al.

(10) Patent No.: US 6,679,411 B2
(45) Date of Patent: Jan. 20, 2004

(54) PISTON RETENTION SYSTEM FOR A FASTENER DRIVING TOOL

(75) Inventors: Michael S. Popovich, Bartlett, IL (US); Edward D. Yates, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 7 days.

(21) Appl. No.: 10/036,958

(22) Filed: Dec. 21, 2001

(65) Prior Publication Data

US 2003/0116602 A1 Jun. 26, 2003

(51) Int. Cl.[7] ..... B25C 1/00
(52) U.S. Cl. ..... 227/10; 227/11; 173/210
(58) Field of Search ..... 173/210; 227/10, 227/9, 11

(56) References Cited

U.S. PATENT DOCUMENTS

| | | | | | |
|---|---|---|---|---|---|
| 3,083,692 | A | * | 4/1963 | Reynolds | 121/11 |
| 3,969,988 | A | | 7/1976 | Maurer | |
| 4,824,003 | A | * | 4/1989 | Almeras et al. | 227/10 |
| 4,941,391 | A | | 7/1990 | Ehmig et al. | |
| 5,050,687 | A | * | 9/1991 | Prokhorov et al. | 173/133 |
| 5,441,192 | A | | 8/1995 | Sugita et al. | |
| 5,538,172 | A | * | 7/1996 | Jochum et al. | 227/10 |
| 5,860,580 | A | | 1/1999 | Velan et al. | |
| 5,881,940 | A | | 3/1999 | Almeras et al. | |
| 5,896,934 | A | * | 4/1999 | Yaniero et al. | 173/132 |
| 5,950,900 | A | | 9/1999 | Frommelt et al. | |
| 6,059,163 | A | * | 5/2000 | Pfister et al. | 227/10 |
| 6,092,710 | A | | 7/2000 | Kersten | |
| 6,123,242 | A | * | 9/2000 | Kersten | 227/10 |
| 2001/0011535 | A1 | | 8/2001 | Thieleke et al. | |

FOREIGN PATENT DOCUMENTS

| | | |
|---|---|---|
| EP | 0 818 281 | 3/1998 |

* cited by examiner

*Primary Examiner*—Rinaldi I. Rada
*Assistant Examiner*—Gloria R Weeks
(74) *Attorney, Agent, or Firm*—Lisa M. Saltis; Mark W Croll; Donal J. Breh

(57) ABSTRACT

In a fastener driving tool, a retention system for a piston comprises a buffer and a set of bearings in a cage, the bearings being abutted against the buffer. The buffer provides a force urging the bearing radially inwardly toward the piston so that the bearings retain the piston in a predetermined position when the piston is not being actuated.

18 Claims, 2 Drawing Sheets

PISTON RETENTION SYSTEM FOR A FASTENER DRIVING TOOL

BACKGROUND OF THE INVENTION

1. Field of the Invention

The present invention is directed to a retention system for a piston in an actuated fastener driving tool.

2. Description of the Related Art

Actuated fastener driving tools are used in many applications, such as driving fastening pins into concrete or steel. It is common for a driving tool to have a driving means such as explosive powder, combustion of gasoline, or compressed air which acts upon a piston which travels in a barrel. U.S. Pat. No. 5,273,198 assigned to Illinois Tool Works Inc. discloses a powder-actuated fastener driving tool for driving fasteners, such as drive pins, into concrete, masonry, or steel substrates.

It is desirable for actuated fastener driving tools to have a mechanism for retaining a piston in the barrel in a rearward position prior to firing of the tool to maintain the optimum chamber volume for optimal performance of the tool. U.S. Pat. No. 4,941,391 discloses the use of ball bearings at the muzzle of the tool for retaining the piston in the most rearward position with a set of springs providing the force to urge the bearings toward the piston. U.S. Pat. Nos. 5,950,900 and 6,092,710 also disclose the use of bearings to retain the piston, but instead use a spring washer and a ring, respectively, to provide the force upon the bearings to urge them towards the piston.

While the retention devices of U.S. Pat. Nos. 4,941,391, 5,950,900 and 6,092,710 may be effective in retaining the piston during normal operation, they present problems due to their complexity and their positioning within the tool. The springs, spring washers, rings and bearings of the prior retention components are all items that wear down due to the large, violent, and frequent forces exerted by the piston. The components are generally placed within the muzzle of the tool and the entire muzzle must be disassembled to replace the wear items. Also, because the retention components themselves are complex, they require excessive disassembly and reassembly time for the retention components to function properly.

U.S. Pat. Nos. 4,941,391, 5,273,198 and 5,950,900 also disclose a buffer for absorbing shock from the piston. The buffer provides a method for dampening the piston when it is driven to avoid damage to the piston or the tool. The buffer is also a wear item that is usually placed in the barrel of the tool to absorb shock before it can be felt in the muzzle or other parts of the tool.

What is needed is a piston retention system that eliminates the need of a complicated design with springs, washers or rings within the fastener driving tool. Also what is needed is a system that allows the easy and simultaneous change-out of both of the wear items, the bearings and the buffer, to allow shortened maintenance times for the tool.

BRIEF SUMMARY OF THE INVENTION

It is an object of the present invention to provide a simplified piston retention system for a fastener driving tool to retain a piston in a predetermined position when the tool is not being fired.

It is another object of the invention to provide a piston retention system that incorporates a set of bearings and the buffer so that the bearings may be removed from the muzzle and so that the wear items of the bearings and the buffer may be placed in the same general location for easy maintenance change-out.

In accordance with the present invention a piston retention system is provided for a fastener driving tool. The piston retention system for an actuable piston includes a buffer for absorbing shock from the piston, a set of bearings abutted against the buffer and a cage for retaining the bearings. The buffer is situated so that it provides a force upon the bearings, urging the bearings radially inward towards the piston so that the piston is retained in a predetermined position when the piston is not being actuated. The actuable piston, the buffer, the bearings and the cage are placed within a barrel of a piston guide of a fastener driving tool. A muzzle having a through bore may also be connected to the piston guide to guide the piston as it is being driven and to guide a fastener being driven by the piston.

The present invention simplifies the design of the piston retention system by combining the buffer with the bearings and eliminates the need for a complicated apparatus in the muzzle. The simplified design also provides for less expensive manufacturing costs.

The novel piston retention system of the present invention allows for the rapid and easy modular change-out of both the bearings and the buffer, both of which are wear items. This modular change-out improves maintenance time and costs.

These and other objects, features and advantages are evident from the following description of an embodiment of the present invention, with reference to the accompanying drawings.

DETAILED DESCRIPTION OF THE INVENTION

Figure 1:
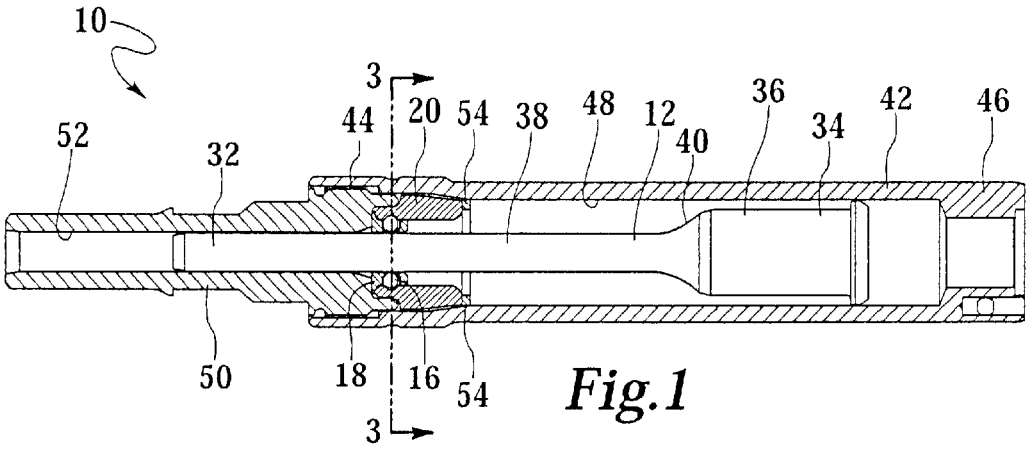
FIG. 1 is an axial sectional view of the piston retention system.

Referring to FIG. 1, a novel and improved retention system 10 for a piston 12 of an actuated fastener driving tool 14 is shown. The inventive piston retention system 10 advantageously incorporates a set of bearings 16 retained within a bearing cage 18 and a buffer 20. Buffer 20 serves the dual purpose of absorbing shock from piston 12, particularly when piston 12 is in an overdrive situation, so that both piston 12 and tool 14 are protected from damage, and providing a force on bearings 16, urging bearings 16 radially inward so that bearings 16 retain piston 12 in a predetermined position when piston 12 is not being fired. The inventive retention system 10 combines two functions, piston retention and piston shock absorption and protection, into one assembly creating a less complex, more cost-effective and easier to maintain piece of equipment.

Figure 2:
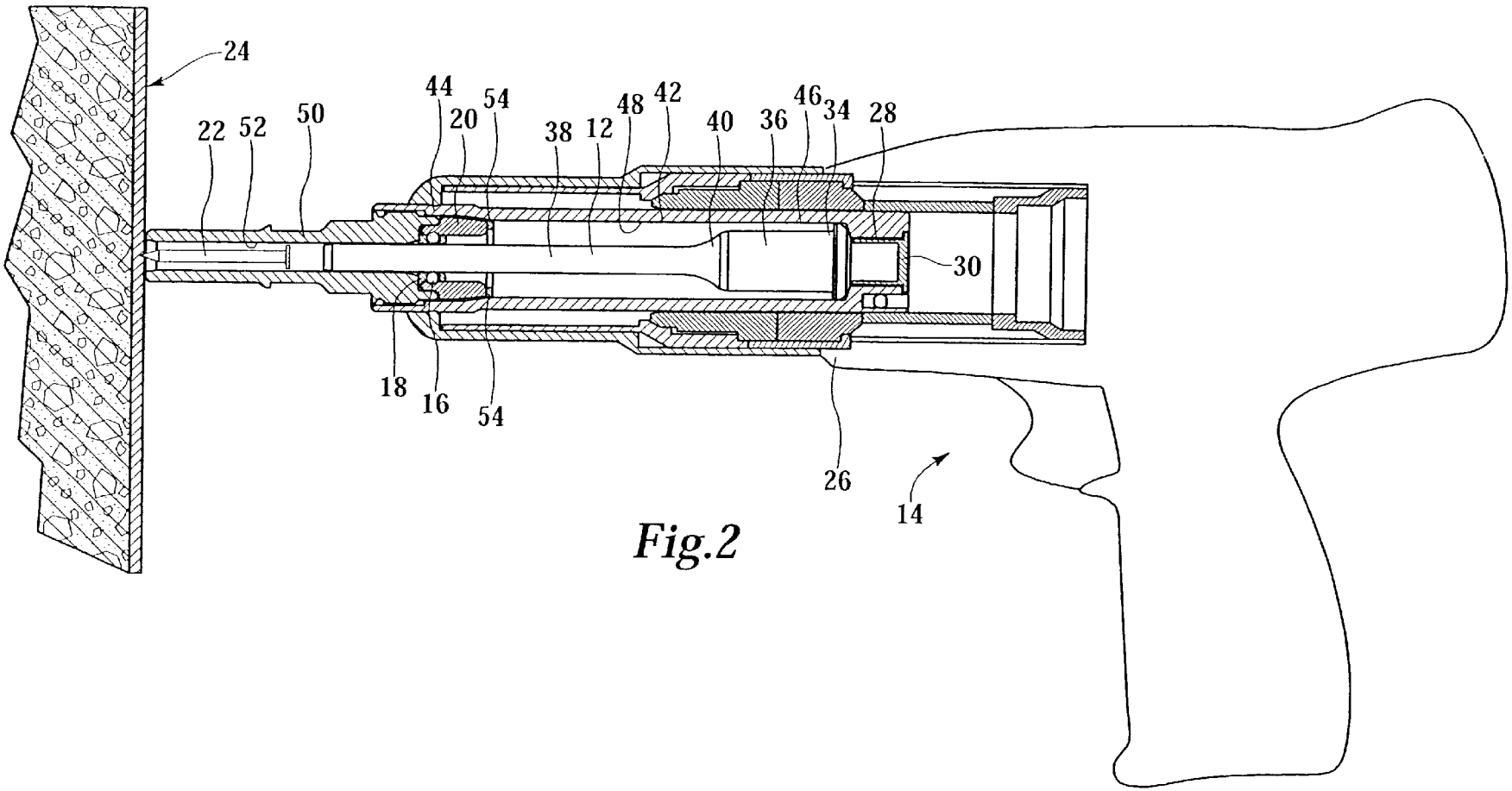
FIG. 2 is an axial sectional view of a fastener driving tool using the piston retention system of FIG. 1.

FIG. 2 shows a fastener driving tool 14 in a ready-to-fire position with the left side of tool 14 being the leading, or driving end, and the right side of tool 14 being the trailing end. Tool 14 may be used for driving a fastener 22 into a substrate 24 such as concrete or steel.

Tool 14 has a housing 26 to enclose other parts of tool 14. Within housing 26 of tool 14 there is a chamber 28 where the driving force of tool 14 is created. Several means can be used to create the force necessary to drive piston 12, such as gasoline combustion or explosive powder. For ease of discussion, tool 14 will be described as being actuated by an explosive powder; however, tool 14 is not limited to an explosive powder actuated tool.

An explosive powder cartridge 30 having a predetermined amount of explosive powder is placed within chamber 28 prior to each firing of tool 14. After ensuring piston 12 is in a predetermined firing position, a firing pin (not shown) is driven forward, such as by a spring, and strikes powder cartridge 30, creating a small, controlled explosion within chamber 28, forcing piston 12 forward with sufficient force to drive fastener 22 into substrate 24. The firing pin and powder cartridge 30 may be similar to those disclosed in Popovich et al. U.S. Pat. No. 5,273,198, the disclosure of which is incorporated herein by reference.

Piston 12 imparts a force on a fastener 22 to drive fastener 22 into substrate 24. As shown in FIG. 1, piston 12 includes a leading, or driving end 32 and a trailing end 34. Piston 12 has a head 36 at trailing end 34 and an elongated shank 38 extending from head 36 in the driving direction. The cross-section of piston 12 could be of any geometric shape, but piston 12 is preferred to be generally cylindrical having a diameter and a length. Force from the controlled explosion within chamber 28 is transferred to head 36 so that piston 12 is forced in the driving direction towards fastener 22.

It is preferred that the diameter of head 36 be larger than the diameter of shank 38 and that shank 38 have a tapered section 40 where shank 38 adjoins head 36. It is preferred that the length of shank 38 be significantly longer than the length of head 36 and that the overall length of piston 12 be significantly larger than the diameter of both head 36 and shank 38.

As shown in FIG. 2, a piston guide 42 is encased within housing 26 of tool 14. Piston guide 42 includes a leading portion 44 and a trailing portion 46. Piston guide 42 also includes a barrel 48 for containing piston 12. The diameter of barrel 48 of piston guide 42 is such that head 36 of piston 12 fits within barrel 48 within a predetermined tolerance.

Piston guide 42 is connected to a muzzle bushing 50 at leading portion 44. Muzzle bushing 50 includes a through bore 52 for shank 38 of piston 12 to pass through. Muzzle bushing 50 may be connected to piston guide 42 by any number of methods, but it is preferred that the connection be releasable, such as a threaded connection, so that tool 14 can be easily disassembled and reassembled. The diameter of through bore 52 of muzzle bushing 50 is such that shank 38 of piston 12 fits within through bore 52 within a predetermined tolerance. Fastener 22 can also be placed into through bore 52, as shown in FIGS. 1 and 2, to guide the fastener as it is driven by piston 12 into substrate 24.

Both barrel 48 of piston guide 42 and through bore 52 of muzzle bushing 50 act as guides so that piston 12 remains radially centered and in the proper position to drive fastener 22. For this reason the tolerances between barrel 48 and head 36 and between through bore 52 and shank 38 should be as small as possible while still allowing free movement of piston 12.

It is preferred that piston retention system 10 be placed within barrel 48 near muzzle bushing 50. Retention system 10 includes a buffer 20, a set of bearings 16, and a bearing cage 18 to retain bearings 16. Buffer 20 acts to protect piston 12 by absorbing shock and acts to prevent piston 12 from dropping prior to the firing of tool 14 by providing a force upon bearings 16 that retains piston 12 in a predetermined position. The dual purpose of buffer 20 simplifies the design of piston retention system 10 which allows for easier and cheaper manufacturing of tool 14. The dual design also allows for easier, simultaneous change-out of wear items like bearings 16 and buffer 20.

Buffer 20 is placed between muzzle bushing 50 and a partition 54 in barrel 48 as shown in FIG. 1. Partition 54 is an annular piece connected to the inside of piston guide 42 and acts to hold buffer 20 in place at the leading end of buffer 20 without interfering with buffer 20 absorbing shock from piston 12. In one embodiment partition 54 has a width of about 0.05 inches.

Buffer 20 absorbs shock from piston 12 when piston 12 has been driven. Buffer 20 protects piston 12 and other parts of tool 14 from damage due to the high forces that are associated with the explosive nature of tool 14. Buffer 20 is particularly necessary to protect piston 12 and tool 14 in an overdrive situation of piston 12.

Figure 4:
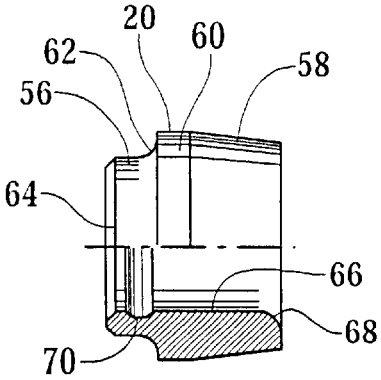
FIG. 4 is a partial sectional view of the buffer.

Buffer 20 may be of any geometrical shape, but should have generally the same cross-sectional shape as piston 12. In one embodiment, buffer 20 is generally cylindrical in shape with a leading section 56 and a trailing section 58 as shown in FIG. 4. Trailing section 58 of buffer 20 is generally frusto-conical in shape with a small cylindrical portion 60. The maximum diameter of leading section 56 is preferred to be approximately the same as the diameter of head 36 of piston 12 so that buffer 20 fits within barrel 48 within a predetermined tolerance.

Leading section 56 is generally cylindrical in shape except for a flared portion 62 where the leading section 56 and trailing section 58 adjoin and a beveled portion 64 at the leading end of leading section 56. The diameter of leading section 56 should be smaller than the diameter of trailing section 58 so that muzzle bushing 50 can fit over leading section 58 as shown in FIG. 1.

The interior surface 66 of buffer 20 is generally cylindrical through both leading section 56 and trailing section 58 except for a tapered portion 68 at the trailing end. The shape of at least a portion of tapered section 40 of piston 12 corresponds to at least a portion of tapered portion 68 of buffer 20 because tapered portion 68 of buffer 20 absorbs most of the shock from piston 12 and it is preferred that tapered section 40 of piston 12 and tapered portion 68 of buffer 20 fit together to optimize this shock absorption. The diameter of interior surface 66 should be larger than the diameter of shank 38, but smaller than the diameter of head 36.

Interior surface 66 of buffer 20 also has a set of dimples 70 corresponding to bearings 16 of piston retention system 10. The number of dimples 70 depends on how many bearings 16 are being used, but a preferred number of bearings 16 and dimples 70 are three for each piston retention system 10. The dimples are evenly spaced around interior surface 66. In the case of three dimples 70 corresponding to three bearings 16, each dimple is about 120° from each of the other two dimples. The even spacing of dimples 70 allows bearings 16 also to be evenly spaced. Each dimple 70 is a concave shaped curve with a radius of curvature that is slightly larger than the radius of bearings 16 so that each bearing 16 will fit within a corresponding dimple 70, as shown in FIG. 4.

Buffer 20 may be made of any material that provides some elasticity to absorb shock from piston 12, is substantially heat resistant to the highest operating temperature of tool 14 created by friction within tool 14 and sufficiently wear resistant so that each buffer 20 may last for a substantial time between change-outs. Although the material of buffer 20 should be chosen for its ability to consistently withstand the forces within tool 14, it eventually will wear down. Therefore, it is preferred that the material of buffer 20 be fairly inexpensive, allowing multiple change-outs to be cost-effective. A preferred material would be a resilient, polymeric plastic or rubber, an example being urethane.

Each dimple 70 has a corresponding bearing 16 placed within the dimple 70. Buffer 20 provides a force upon bearings 16 at dimples 70. The force urges bearings 16 radially inward toward piston 12 so that bearings 16 act upon piston 12 to retain it in a predetermined position so that piston 12 does not drop before tool 14 is to be fired. It is particularly important for piston 12 to be retained in a rearward position, or toward the trailing end of tool 14 so that the volume of chamber 28 being utilized is optimized so that tool 14 is operating at its maximum efficiency. Buffer 20 serves two purposes in tool 14, as a shock absorber to protect piston 12 and as the origin of force to retain piston 12 before tool 14 is fired. The dual function of buffer 20 serves to simplify and strengthen the design of tool 14.

Figure 3:
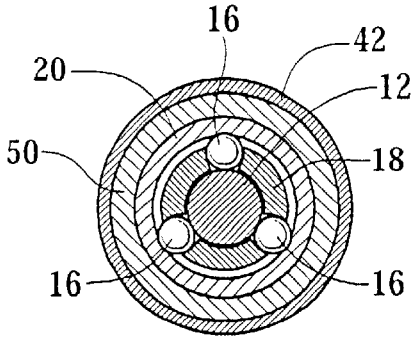
FIG. 3 is a sectional view taken along line 3—3 of FIG. 1.

Bearings 16 are generally spherical in shape and are placed between piston 12 and buffer 20 as shown in FIG. 3. The force provided by buffer 20 against bearings 16 is transferred to piston 12 so that piston 12 is retained in a predetermined position between firings of tool 14.

Any number of bearings 16 could be used in retention system 10, but a preferred number is three or more bearings 16 evenly spaced around the periphery of piston 12 so that force exerted upon piston 12 is even. In the case of three bearings 16, each bearing is spaced about 120° from each of the remaining bearings as shown in FIG. 3. If four bearings 16 were used, it would be preferred that each bearing 16 be spaced about 90° from neighboring bearings.

Bearings 16 should be made of a material that is strong enough to consistently urge a force upon piston 12 and that can withstand the highest operating temperature of tool 14. The material of bearings 16 should be chosen for its strength and durability, but bearings 16 will still wear down due to the extreme forces of piston 12 and will have to be replaced at regular intervals. A preferred material for bearings 16 would be stainless steel, or another high-strength metal.

Bearings 16 and buffer 20 are wear items due to the forces of piston 12 within tool 14. However, when retention system 10 is assembled, bearings 16 and buffer 20 are part of a single piece so that they can be removed and replaced simultaneously during routine maintenance change-outs. The ability to quickly change-out both bearings 16 and buffer 20 simultaneously greatly reduces time requirements and makes tool 14 easier to maintain.

Figure 5:
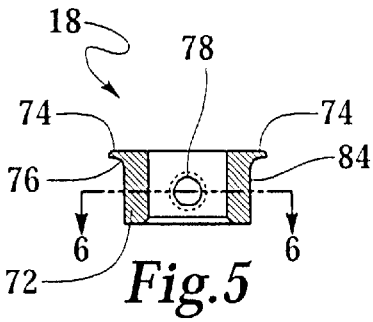
FIG. 5 is a sectional view of the bearing cage taken along line 5—5 of FIG. 6.

Bearings 16 are placed in bearing cage 18 to ensure bearings 16 remain at their predetermined spacing and in alignment with their corresponding dimples 70. As shown in FIG. 5, cage 18 has a cylindrical section 72 and a flange 74 with a slight taper 76 between cylindrical section 72 and flange 74. Cylindrical section 72 is placed within buffer 20 and flange 74 remains outside of buffer 20 as shown in FIG. 1.

Figure 6:
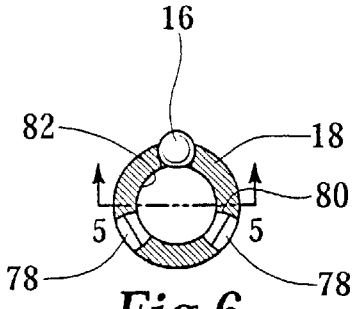
FIG. 6 is a sectional view of the bearing cage taken along line 6—6 of FIG. 5.

Cage 18 also has a set of holes 78 corresponding to bearings 16. For example, if three bearings 16 are used, there are three holes 78 evenly spaced at about 120° from the remaining holes. Each hole 78 extends through cylindrical section 72, as shown in FIG. 6, and is generally cylindrical in shape with a diameter that is slightly larger than the diameter of bearings 16 except for a small flared portion 80 at interior wall 82 of cylindrical section 72 where the diameter of hole 78 becomes smaller than the diameter of bearings 16. Each bearing 16 is placed within its corresponding hole 78 so that a small portion of bearing 16 protrudes past interior wall 82 and an opposite portion of bearing 16 extends past exterior wall 84 of cylindrical portion 60, as shown in FIG. 6. It is the small portion of each bearing 16 that protrudes past interior wall 82 that contacts piston 12 to hold it in position, and it is the portion of each bearing 16 that extends past exterior wall 84 that contacts buffer 20 at dimple 70.

Interior wall 82 of cylindrical section 72 is generally cylindrical in shape with a diameter that is slightly larger than the diameter of shank 38 of piston 12 so that shank 38 fits within cage 18 within a predetermined tolerance. Exterior wall 84 has a diameter slightly smaller than the diameter of interior surface 66 of buffer 20 so that cage 18 fits within buffer 20 within a predetermined tolerance.

Flange 74 of cage 18 remains outside of buffer 20 and is in contact with muzzle bushing 50 as shown in FIG. 1. The contact between flange 74 and muzzle bushing 50 acts to keep cage 18 in place within buffer 20. Flange 74 also acts to keep cage 18 from extending too far into buffer 20. The diameter of flange 74 should be smaller than the diameter of trailing section 58 of buffer 20 so that flange 74 does not extend past the outer wall of buffer 20.

Any dimensions given are strictly to give context to the present invention and to help show relationships between the different parts and are not limiting.

In one embodiment, the diameter of head 36 of piston 12 may be about 0.9 inches, the diameter of shank 38 may be about 0.3 inches, the length of head 36 may be about 1.25 inches and the length of shank 38 may be about 4 inches. Barrel 48 of piston guide 42 may have a diameter of about 0.91 inches and through bore 52 of muzzle bushing 50 may have a diameter of about 0.31 inches.

The diameter of cylindrical portion 60 of buffer may be about 0.9 inches, the diameter of the leading end of leading section 56 of buffer 20 may be about 0.8 inches, the diameter of trailing section 58 of buffer may be about 0.75 inches and the diameter of interior surface 66 of buffer 20 may be about 0.6 inches. Each bearing 16 may have a radius of about 0.08 inches. Each dimple 70 of buffer 20 may have a radius of curvature of about 0.08 inches. Hole 78 of cage 18 may have a diameter of about 0.17 inches and the diameter of each hole 78 at flared portion 80 may be about 0.15 inches.

The diameter of exterior wall 84 of cylindrical section 72 of cage 18 may be about 0.55 inches, the diameter of the interior wall 82 of cylindrical section 72 may be about 0.35 inches and the diameter of flange 74 may be about 0.7 inches.

However, piston retention system 10 is not limited to any of the above dimensions and could be scaled up or down as desired.

The piston retention system 10 of the present invention provides a simplified design of tool 14. Retention system 10 provides the necessary function of retaining piston 12 in a predetermined position to optimize operation of tool 14, and combines this function with protection of piston 12 through shock absorption. The improved retention system 10 of the present invention retains piston 12 in place without the need for parts such as springs or spring washers to be put together in a complicated fashion. The present invention also combines two wear items, bearings 16 and buffer 20, into one piece so that they can be changed-out simultaneously during routine maintenance of tool 14, saving time and money.

The present invention is not limited to the above-described embodiments, but should be limited solely by the following claims.

What is claimed is:

1. A piston buffer and retention system for a fastener driving tool comprising:

a resilient plastic buffer for absorbing shock from a piston traveling in an axial driving direction; and a set of bearings retained in a cage, the bearings being abutted against the buffer and spaced radially between the buffer and the piston;

wherein the buffer provides a radial force urging the bearings radially inwardly toward the piston so that the bearings retain the piston in a ready-to-fire position prior to firing.

2. A retention system according to claim 1, wherein the buffer is made of urethane.

3. A retention system according to claim 1, wherein the bearings are generally spherical in shape.

4. A retention system according to claim 1, wherein there are at least three bearings.

5. A retention system according to claim 1, wherein the bearings are evenly spaced around the periphery of the piston.

6. A retention system according to claim 1, wherein said cage and said bearings are spaced radially between said buffer and said piston.

7. A tool for driving fasteners comprising:

a piston guide having a barrel;

an actuable piston retained in the barrel to drive a fastener in an axial driving direction into a substrate;

means for driving the piston in the axial driving direction;

a piston buffer and retention system including a resilient plastic buffer retained in the barrel for absorbing shock from the piston and a set of bearings retained in a cage, the bearings being abutted against the buffer and being spaced radially between the buffer and the piston;

wherein said piston buffer and retention system is replaceable as an assembly; and wherein the buffer provides a radial force urging the bearings radially inwardly toward the piston so that the bearings retain the piston in a ready-to-fire position prior to firing the tool.

8. A tool according to claim 7, wherein the piston is driven by gasoline combustion.

9. A tool according to claim 7, wherein the piston is driven by explosive powder.

10. A tool according to claim 7, wherein the buffer is made of urethane.

11. A tool according to claim 7, further comprising a muzzle bushing having a through bore for guiding the piston.

12. A tool according to claim 11, wherein the muzzle bushing is releasably connected to the piston guide.

13. A tool according to claim 11, wherein the muzzle bushing and the piston guide are threaded.

14. A tool for driving fasteners comprising:

a piston guide having a barrel;

an actuable piston retained in the barrel to drive a fastener in an axial driving direction into a substrate;

a combustion chamber for exploding powder to drive the piston in the axial driving direction;

a piston buffer and retention system including a resilient plastic buffer retained in the barrel for absorbing shock from the piston and a set of bearings retained in a cage, the bearings being abutted against the buffer and being spaced radially between the resilient plastic buffer and the piston;

wherein said piston buffer and retention system is replaceable as an assembly;

wherein the buffer provides a radial force urging the bearings radially inwardly toward the piston so that the bearings retain the piston in a ready-to-fire position prior to firing the tool.

15. A tool according to claim 14, wherein the buffer is made of urethane.

16. A tool according to claim 14, further comprising a muzzle bushing having a through bore for guiding the piston.

17. A tool according to claim 16, wherein the muzzle bushing is releasably connected to the piston guide.

18. A tool according to claim 16, wherein the muzzle bushing and piston guide are threaded.

* * * * *